US005575039A

United States Patent [19]

Leifeld et al.

[11] Patent Number: 5,575,039

[45] Date of Patent: Nov. 19, 1996

[54] METHOD AND APPARATUS FOR FEEDING A FIBER PROCESSING TEXTILE MACHINE WITH FIBER TUFTS

[75] Inventors: Ferdinand Leifeld, Kempen; Armin Leder, Mönchengladbach, both of Germany

[73] Assignee: Trützschler GmbH & Co. KG, Mönchengladbach, Germany

[21] Appl. No.: 532,250

[22] Filed: Sep. 22, 1995

[30] Foreign Application Priority Data

Sep. 24, 1994 [DE] Germany ..... 44 34 250.0

[51] Int. Cl.[6] ..... D01G 15/40; D01G 23/02; D01G 15/74

[52] U.S. Cl. ..... 19/105; 19/97.5

[58] Field of Search ..... 19/97.5, 105, 296, 19/297, 300, 301, 302, 303, 304, 308

[56] References Cited

U.S. PATENT DOCUMENTS

| | | | |
|---|---|---|---|
| 4,240,180 | 12/1980 | Wood et al. . | |
| 4,656,694 | 4/1987 | Windges . | |
| 4,776,066 | 10/1988 | Leifeld | 19/105 |
| 4,939,815 | 7/1990 | Leifeld | 19/105 |

FOREIGN PATENT DOCUMENTS

| | | |
|---|---|---|
| 2532061 | 2/1977 | Germany . |
| 3239524 | 7/1983 | Germany . |
| 3625311 | 3/1987 | Germany . |
| 1432102 | 10/1988 | U.S.S.R. . |
| 2100304 | 12/1982 | United Kingdom . |
| 2172619 | 9/1986 | United Kingdom . |

*Primary Examiner*—John J. Calvert
*Attorney, Agent, or Firm*—Spencer & Frank

[57] ABSTRACT

A fiber tuft feeder includes a first chute; an opening roller supported at the outlet end of the first chute for receiving fiber tufts therefrom; a second chute extending downwardly from the opening roller; a densifying air stream generating arrangement for introducing a densifying air stream into the second chute to compress the fiber tufts therein; and a guide arrangement for orienting the densifying air stream toward the opening roller to combine the densifying air stream with an additional air stream generated by the opening roller by rotation thereof, for aligning the combined air stream in a direction of the second chute and for directing the combined air stream away from the opening roller into the second chute. There is further provided an arrangement for discharging fiber material from the second chute through an outlet thereof.

21 Claims, 5 Drawing Sheets

FIG. 2a
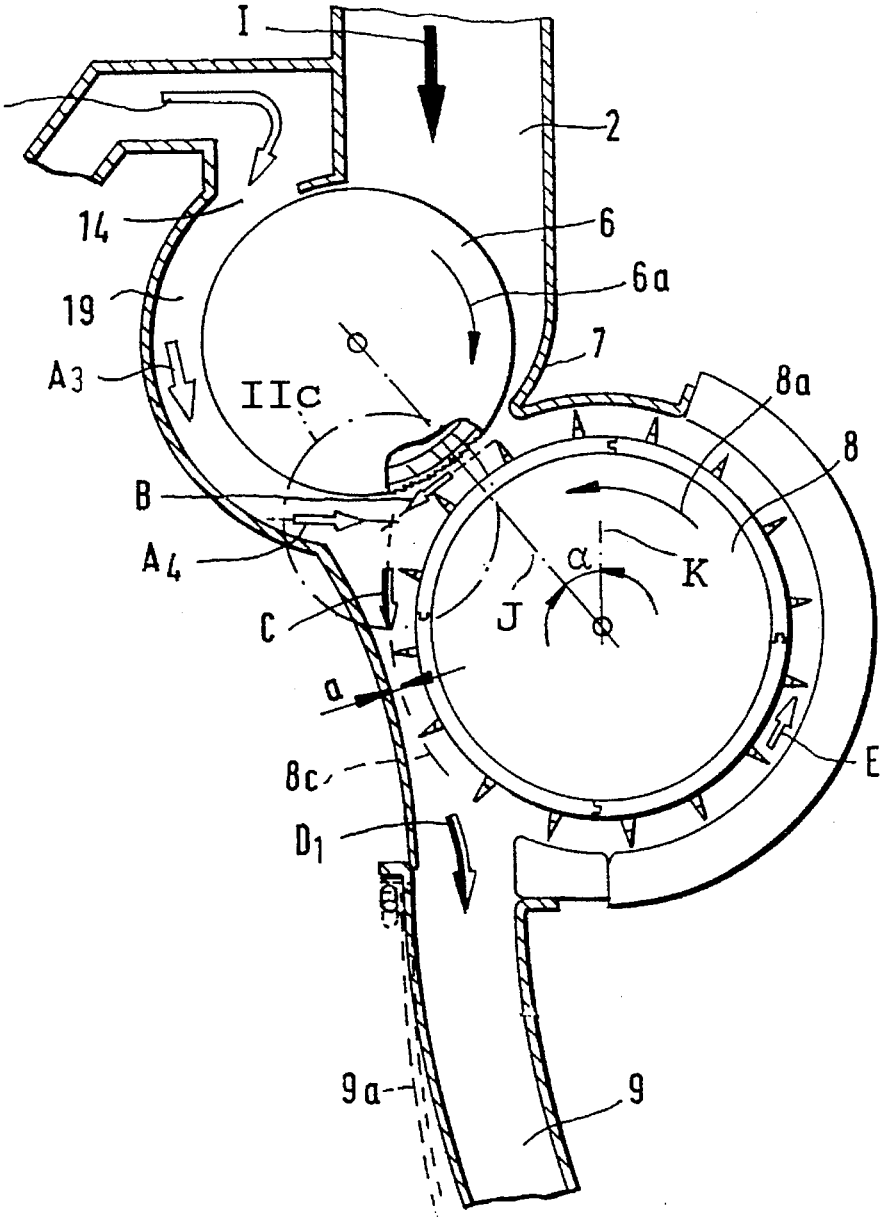
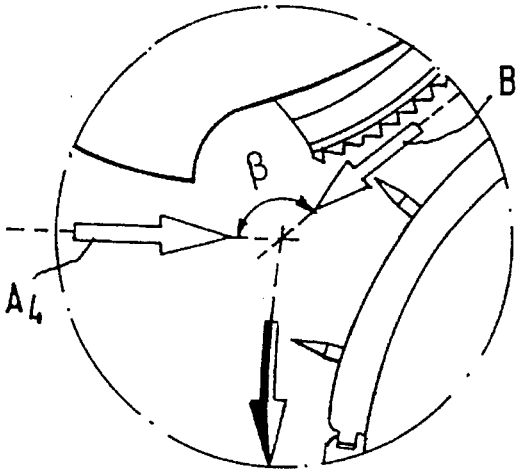
FIG. 2c

METHOD AND APPARATUS FOR FEEDING A FIBER PROCESSING TEXTILE MACHINE WITH FIBER TUFTS

CROSS REFERENCE TO RELATED APPLICATION

This application claims the priority of German Application No. P 44 34 250.0 filed Sep. 24, 1994, which is incorporated herein by reference.

BACKGROUND OF THE INVENTION

This invention relates to a method and an apparatus for feeding fiber tufts to a fiber processing textile machine, such as a carding machine or a roller card unit. The apparatus (fiber tuft feeder) has an upper or reserve chute and an adjoining lower or feed chute. The fiber tufts are advanced from the upper chute into the lower chute by an opening roller. The feeder includes a device which generates a densifying air stream introduced at an upper end of the lower chute for compressing the fiber tuft mass therein. The rapidly rotating opening roller generates an additional air stream. The two air streams pass through a channel together and enter the lower chute from the channel.

In a known method and apparatus of the above-outlined type, as disclosed in German Offenlegungsschrift (application published without examination) No. 35 28 853, the densifying air stream is introduced into the zone of the opening roller codirectionally with its rotation and approximately tangentially thereto. The densifying air stream and the additional air stream flow codirectionally and meet at a nose-like projection, resulting in turbulence. Then the two air streams enter the channel and are combined into a single air stream only at that location. The channel is of curved configuration until it merges into the lower chute and is bent in the direction of the lower chute. At its outlet the channel does not widen appreciably, that is, the air stream flowing from the opening roller cannot expand to a significant extent, so that upon its entrance into the lower chute a certain turbulence is generated which is also enhanced by the effect of the opening roller.

SUMMARY OF THE INVENTION

It is an object of the invention to provide an improved apparatus of the above-outlined type from which the discussed disadvantages are eliminated and which, in particular, improves the flow of the densifying air stream and makes possible an improved guidance of the fiber material in the lower chute.

This object and others to become apparent as the specification progresses, are accomplished by the invention, according to which, briefly stated, the fiber tuft feeder includes a first chute; an opening roller supported at the outlet end of the first chute for receiving fiber tufts therefrom; a second chute extending downwardly from the opening roller; a densifying air stream generating arrangement for introducing a densifying air stream into the second chute to compress the fiber tufts therein; and a guide arrangement for orienting the densifying air stream toward the opening roller to combine the densifying air stream with an additional air stream generated by the opening roller by rotation thereof, for aligning the combined air stream in a direction of the second chute and for directing the combined air stream away from the opening roller into the second chute. There is further provided an arrangement for discharging fiber material from the second chute through an outlet thereof.

By virtue of the fact that the densifying air stream flows in the direction of—that is, at an inclination to—the opening roller, in contrast to a direction which is tangential to the opening roller, the densifying air stream meets the additional air stream generated by the opening roller and combines therewith into a single air stream. During this occurrence the additional air stream entrains the densifying air stream towards the channel in the direction of rotation of the opening roller. The combined air stream enters the channel and is redirected there towards the lower chute. At the outlet of the channel the air stream widens (expands) and thus it can flow from the opening roller, together with the fiber tufts into the lower chute, while slightly bending away from the opening roller. During this occurrence the air stream may expand which also prevents the air stream from being entrained by the opening roller back into the clearance between the opening roller and the facing wall surface. In this manner a directed, non-turbulent densifying air current is generated which forcefully enters the lower chute.

Expediently, the densifying air stream and the additional air stream generated by the opening roller converge perpendicularly, or at an obtuse angle. Advantageously, the channel has a restriction and the combined air stream flows in the channel approximately tangentially to the opening roller. The combined air stream exits through the channel while it expands therein. The combined air stream flows at a slight curve against the curvature of the opening roller in the direction of the lower chute.

BRIEF DESCRIPTION OF THE DRAWINGS

FIG. 2*a* is an enlarged schematic sectional side elevational view of a detail of FIG. 1.

FIG. 2*c* is an enlarged detail of inset IIc in FIG. 2*a*.

DESCRIPTION OF THE PREFERRED EMBODIMENTS

Figure 1:
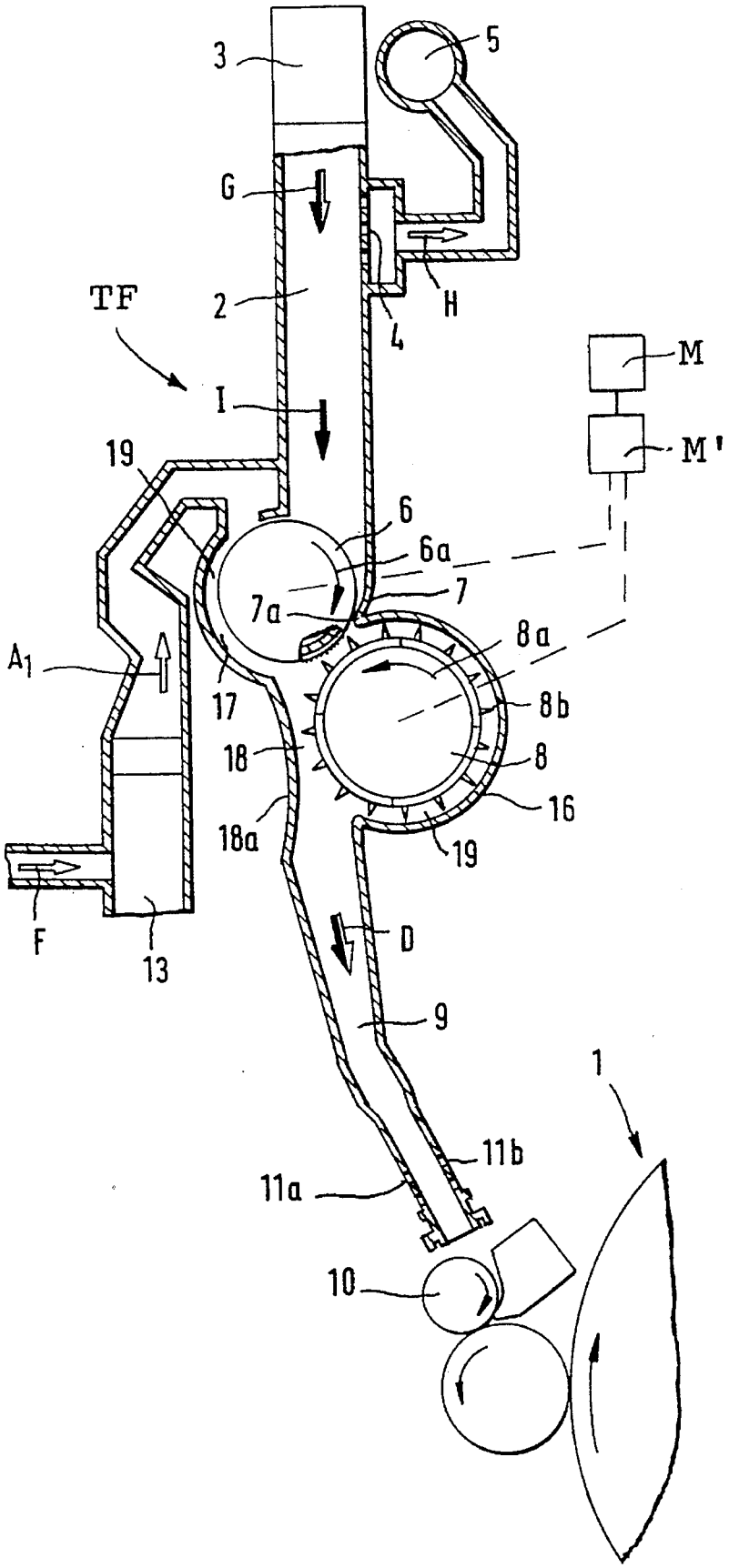
FIG. 1 is a schematic sectional side elevational view of a preferred embodiment of the invention.

Turning to FIG. 1, a tuft feeder generally designated at TF is arranged at the input side of a carding machine 1. The tuft feeder TF has a vertical reserve chute (upper chute) 2 which is charged through an upper chute inlet with finely opened fiber material. Such charging operation may be performed, for example, by means of a condenser, via a supply-and-distributing duct 3. In the upper zone of the reserve chute 2, air outlet openings 4 are provided through which the transporting air stream G may pass into a suction device 5 in the direction of the arrow H after the fiber tufts have been separated from the transporting air stream. The lower end of the reserve chute 2 is obturated by a feed roller 6 which cooperates with a feed tray 7. The feed roller 6 advances the fiber material I into an underlying adjacent, rapidly rotating opening roller 8 which is provided with pins 8*b* or a sawtooth clothing and which, along a path of its circumference, faces a feed chute (lower chute) 9. A phantom-line circle 8*c* in FIG. 3 indicates the periphery of the opening roller 8 as defined by the points of pins 8*b*. The opening roller 8 which is rotated in the direction of the arrow 8*a* delivers the fiber material caught thereby into the feed chute 9. The feed chute 9 has at its lower end a delivery roller 10 which advances the fiber material (fiber lap) from the feed chute 9 to the carding machine 1. The feeder with features as outlined above, may be, for example, an EXACTAFEED FBK model, manufactured by Trützschler GmbH & Co. KG, Mönchengladbach, Germany. A motor M, associated with appropriate gearing M', rotates the feed roller 6 slowly in the direction of the arrow 6*a* while it rotates the opening roller 8 rapidly in the opposite rotary direction 8*a*.

The lower wall portion of the feed chute 9 is provided with air outlet openings 11*a*, 11*b*. Also referring to FIG. 3, the feed chute 9 communicates at its top with a chamber 12 with the intermediary of a channel 12*a*. The chamber 12 is connected at one end with the pressure side of a fan 13.

The rotating feed roller 6 and the rotating opening roller 8 continuously supply a certain amount of fiber material into the feed chute 9 and the same amount of fiber material is withdrawn from the feed chute 9 by the delivery roller 10 and advanced to the carding machine 1. In order to ensure that such quantities are uniformly condensed and maintained constant, a densifying air stream is driven by the fan 13 through the chamber 12 and a constriction (wide-slot nozzle) 14 downstream of the chamber 12. In the feed chute 9 the fiber material is exposed to the densifying air stream. The fan 13 draws air from the air outlet channel 15*a* communicating with the air outlet openings 11*a*, 11*b* and drives the air into the fiber mass present in the feed chute 9. Thereafter the air exits through the air outlet openings 11*a*, 11*b* at the lower end of the feed chute 9 into the air outlet channel 15*a* as illustrated by the arrow F. The opening roller 8 and the feed roller 6 are partially circumferentially surrounded by a wall face of respective housings 16 and 17. These wall faces conform to the circular configuration of the rollers 6 and 8. As viewed in the direction of rotation 8*a* of the opening roller 8, the housing 16 is interrupted by a separating opening 18 for the fiber material. The separating opening 18 is joined by a channel 19 bounded by the housing 16 and the circumferential surface of the opening roller 8. The channel 19 extends to the feed roller 6. The feed tray 7 is arranged at the lower end of the wall region facing the feed roller 6. The edge 7*a* of the feed tray 7 is oriented in the rotary direction 8*a* of the opening roller 8.

Referring particularly to FIG. 2*a*, The plane J which contains the rotary axes of the feed roller 6 and the opening roller 8 is inclined under an angle $\alpha$ of between about 30° to 90° (for example, 35°) with respect to the vertical plane K containing the rotary axis of the opening roller 8, in the direction of rotation of the opening roller 8. Stated differently, the plane J divides the opening roller 8 into a first and a second side. By virtue of the direction of rotation of the opening roller 8, the fiber tufts are thrown thereby into the first side. The plane J is inclined relative to the plane K towards the first side. The channels 18 and 19 and the feed chute 9 are in communication with one another. The wall face 9*a* of the feed chute 9 may be adjusted in the width direction as illustrated in FIG. 2*a*.

Figure 2B:
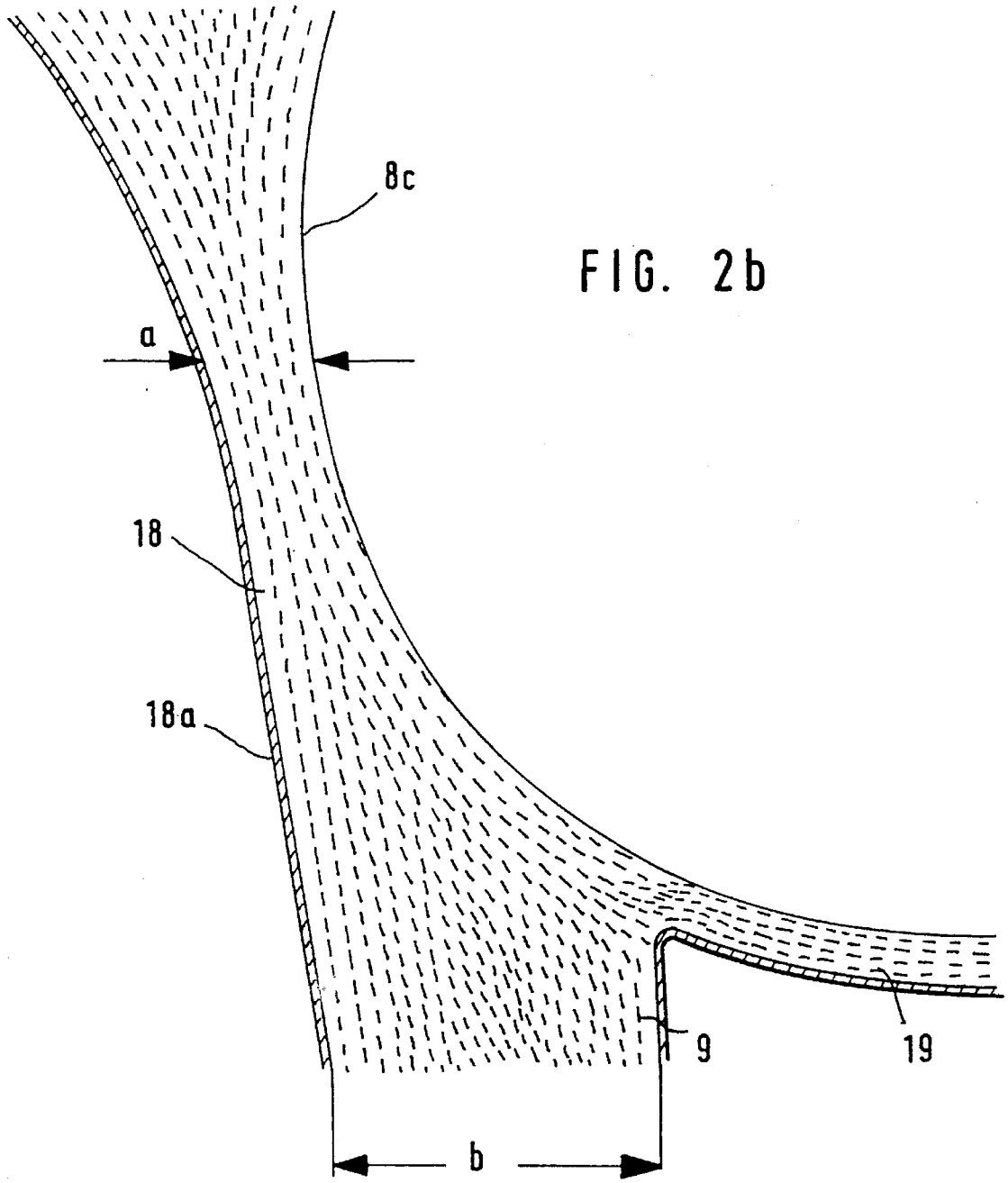
FIG. 2*b* is a schematic sectional side elevational view of a part of FIG. 2*a* showing flow behavior.
Figure 3:
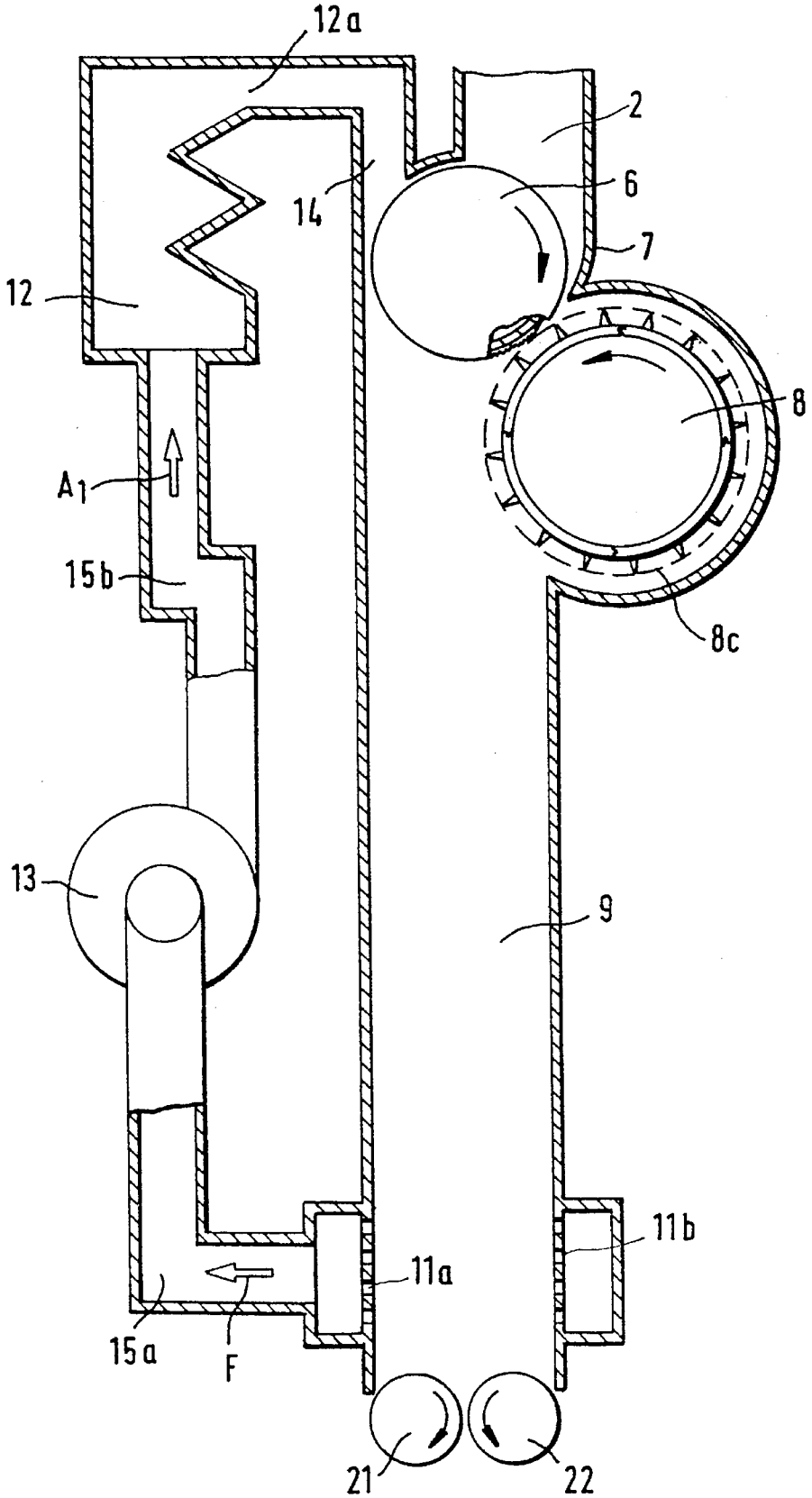
FIG. 3 is a schematic sectional side elevational view of a variant of the preferred embodiment.

Particularly referring to FIGS. 2*a* and 3, the densifying air stream exits from the pressure side of the fan 13, passes through the conduit 15*b* and the chamber 12 as indicated by arrow $A_1$, and enters the wide-slotted nozzle 14, as indicated by the arrow $A_2$. Thereafter, the densifying air stream proceeds, as indicated by the arrow $A_3$ through the chamber 19 at that side of the feed roller 6 and the opening roller 8 at which the feed chute 9 begins. First the air stream flows along the feed roller 6 and thereafter along the opening roller 8. During this occurrence, the densifying air current flows against the rotary direction 6*a* of the feed roller 6 and thus blows back fiber tufts still adhering to the feed roller 6.

The rapidly rotating opening roller 18, as also illustrated in FIG. 2*c*, entrains an air stream B. The densifying air stream, as shown at $A_4$, flows in the direction of the opening roller 8 and merges with the air stream B under an angle $\beta$ which is at least 90° ($\beta$ is shown to be obtuse in FIG. 2*c*). Thereafter, the air streams $A_4$ and B are combined into an air stream C which flows in the rotary direction 8*a* of the opening roller 8 in the chamber 18 and passes through a constriction a provided in the chamber 18. During this occurrence, as shown in FIG. 2*b*, the combined air stream C is aligned and oriented in the direction of the upper opening of the feed chute 9 and flows from the opening roller 8 slightly deflected into the feed chute 9 as an air stream $D_1$. At the same time, the air stream $D_1$ entrains fiber tufts thrown by the opening roller 8. By virtue of the fact that the channel 18 widens in the direction of the feed chute 9 by a curving of the wall faces 18*a* from distance a to distance b, the fiber tuft-laden air stream $D_1$ may expand downstream of the opening roller 8 and is thus not entrained by the opening roller 8 into a circumferential path but it enters the chamber 19 only as a branched, lesser residual air stream E.

The opening roller 8 supplies fiber tufts into the air streams C and $D_1$. The channel 18 extends essentially along a lateral zone of the opening roller 8 so that the air streams $A_4$, C and $D_1$ in the feed chute 9, serving for densifying the fiber material are effective along the opening roller 8. The separation of the fiber tufts from the needles 8*b* of the opening roller 8 effected by centrifugal forces may be, for example, pneumatically supported.

Figure 4:
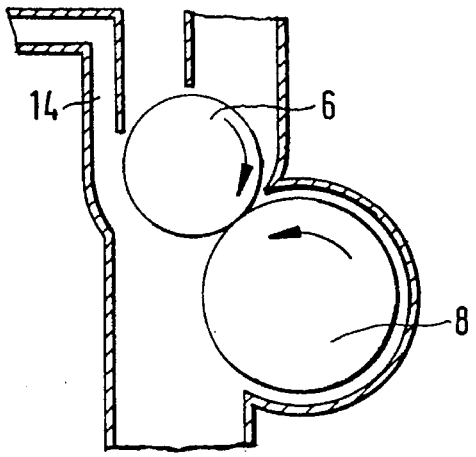
FIGS. 4, 5 and 6 are schematic side elevational sectional details of the general construction of FIG. 1 showing three variants.
Figure 5:
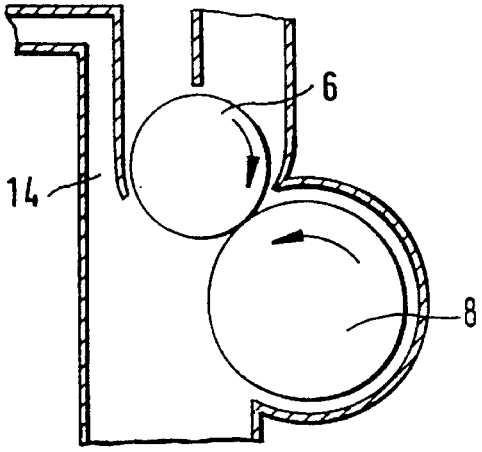
Figure 6:
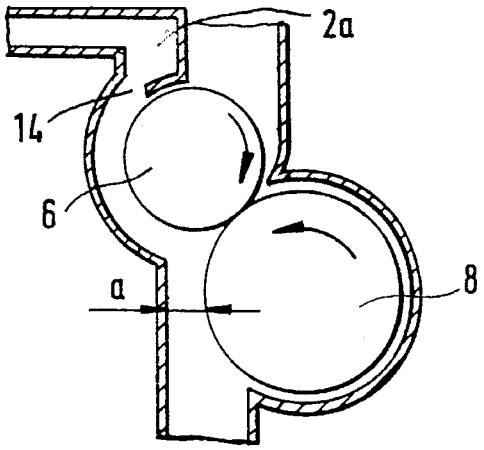

As shown in FIG. 4, the outlet of the wide-slotted nozzle 14 faces the circumferential face of the feed roller 6 above the horizontal diameter of the feed roller 6. According to FIG. 5, the nozzle 14 opens underneath the horizontal diameter of the feed roller 6 such that the circumferential surface of the feed roller 6 is essentially screened. As shown in FIG. 6, the wide-slotted nozzle 14 and the upper chute 2 have a common wall 2*a*, that is, the sheet metal chute wall has a dual use.

It will be understood that the above description of the present invention is susceptible to various modifications, changes and adaptations, and the same are intended to be comprehended within the meaning and range of equivalents of the appended claims.

What is claimed is:

1. A fiber tuft feeder comprising (a) a first chute having an upper, inlet end and a lower, outlet end;

(b) charging means for introducing fiber tufts into said first chute through said inlet end;

(c) an opening roller supported in a zone of said outlet end; said opening roller having a rotary axis; said opening roller receiving fiber tufts from said first chute;

(d) a second chute extending downwardly from said opening roller and having an outlet;

(e) densifying air stream generating means for introducing a densifying air stream into said second chute to densify the fiber tufts therein;

(f) guide means for orienting said densifying air stream toward said opening roller in a direction other than tangentially thereto to combine said densifying air stream with an additional air stream generated by said opening roller by rotation thereof, for aligning the combined air stream in a direction of said second chute and for directing the combined air stream away from said opening roller into said second chute; and (g) means for discharging fiber material from said second chute through said outlet thereof.

2. The fiber tuft feeder as defined in claim 1, wherein said guide means includes means for effecting a meeting of said densifying air stream and said additional air stream at an angle of at least 90°.

3. The fiber tuft feeder as defined in claim 1, wherein said guide means include means for defining a channel bordered by a circumferential surface portion of said opening roller; said channel having an initial length portion narrowing in a downstream direction as viewed in a direction of air flow therein; said initial length portion having an inlet for introducing the combined air stream into said channel.

4. The fiber tuft feeder as defined in claim 3, further wherein said channel has a terminal length portion widening in a downstream direction as viewed in a direction of air flow therein; said terminal length portion having an outlet for discharging the combined air stream from said channel.

5. The fiber tuft feeder as defined in claim 4, wherein said terminal portion curves away from said opening roller in the downstream direction.

6. The fiber tuft feeder as defined in claim 1, further comprising a feed roller supported at said outlet end of said first chute; said feed roller having a rotary axis; an imaginary plane containing said rotary axes dividing said feed roller and said opening roller into first and second sides; said opening roller throwing fiber tufts to said first side.

7. The fiber tuft feeder as defined in claim 6, said imaginary plane is inclined to the vertical at an angle of 30°to 90°.

8. The fiber tuft feeder as defined in claim 6, wherein said guide means comprises means defining a channel leading into said second chute.

9. The fiber tuft feeder as defined in claim 8, wherein said channel extends from said feed roller.

10. The fiber tuft feeder as defined in claim 8, wherein said guide means further comprises a nozzle situated upstream of said channel as viewed in a direction of flow of the densifying air stream; said nozzle adjoining said feed roller.

11. The fiber tuft feeder as defined in claim 8, wherein said second chute has a wall provided with an extension having a first length portion facing said feed roller and a second length portion facing said opening roller; said extension forming part of said means defining said channel.

12. The fiber tuft feeder as defined in claim 11, wherein said feed roller and said opening roller each have circumferential surfaces and further wherein a ratio of a distance of said circumferential surface of said feed roller from said first length portion approximately equals a distance of said circumferential surface of said opening roller from said second length portion.

13. The fiber tuft feeder as defined in claim 11, wherein said feed roller and said opening roller each have circumferential surfaces and further wherein a ratio of a distance of said circumferential surface of said feed roller from said first length portion to a distance of said circumferential surface of said opening roller from said second length portion is approximately 1:2.

14. The fiber tuft feeder as defined in claim 11, said means defining said channel including said extension, said feed roller and said opening roller.

15. The fiber tuft feeder as defined in claim 14, wherein said channel has a constriction defined between said extension and said opening roller; said channel having a length portion widening towards said second chute from said constriction.

16. The fiber tuft feeder as defined in claim 15, wherein said constriction has a cross-sectional area which is approximately 50% to 70% smaller than a cross-sectional area of said channel in a region of said feed roller.

17. The fiber tuft feeder as defined in claim 6, wherein said guide means further includes means for directing said densifying air stream to flow consecutively along said feed roller and said opening roller on said first side.

18. A method of supplying fiber tufts to a fiber processing textile machine by a fiber tuft feeder including a first chute having an upper, inlet end and a lower, outlet end; an opening roller supported in a zone of said outlet end; and a second chute extending downwardly from said opening roller and having an outlet; said method comprising the following steps:

(a) introducing fiber tufts into said first chute through said inlet end thereof;

(b) rotating said opening roller;

(c) generating a densifying air stream;

(d) generating an additional air stream by the rotation of said opening roller;

(e) guiding said densifying air stream toward said opening roller in a direction other than tangentially thereto and combining said densifying air stream with said additional air stream into a single, combined air stream;

(f) aligning the combined air stream in a direction of said second chute and directing the combined air stream away from said opening roller into said second chute; for compressing the fiber tufts therein; and (g) discharging fiber material from said second chute through said outlet thereof.

19. The method as defined in claim 18, wherein the guiding step comprises the step of guiding said densifying air stream onto said additional air stream at an angle of at least 90°.

20. The method as defined in claim 18, further comprising the step of guiding, after the combining step, the combined air stream in a channel approximately tangentially to said opening roller.

21. The method as defined in claim 18, further comprising the step of slightly bending the combined air stream toward said second chute in a direction opposite to a direction of curvature of said opening roller.

* * * * *